US010486325B2

(12) United States Patent
Bickelhaupt et al.

(10) Patent No.: US 10,486,325 B2
(45) Date of Patent: Nov. 26, 2019

(54) METHOD FOR LIQUID-JET CUTTING

(71) Applicant: Robert Bosch GmbH, Stuttgart (DE)

(72) Inventors: Malte Bickelhaupt, Stuttgart (DE); Jens-Peter Nagel, Marbach (DE); Uwe Iben, Khimki (RU)

(73) Assignee: Robert Bosch GmbH, Stuttgart (DE)

( * ) Notice: Subject to any disclaimer, the term of this patent is extended or adjusted under 35 U.S.C. 154(b) by 225 days.

(21) Appl. No.: 15/534,497

(22) PCT Filed: Oct. 27, 2015

(86) PCT No.: PCT/EP2015/074887

§ 371 (c)(1),
(2) Date: Jun. 9, 2017

(87) PCT Pub. No.: WO2016/091447

PCT Pub. Date: Jun. 16, 2016

(65) Prior Publication Data

US 2018/0015631 A1 Jan. 18, 2018

(30) Foreign Application Priority Data

Dec. 9, 2014 (DE) ..... 10 2014 225 247

(51) Int. Cl.
*B26F 3/00* (2006.01)
*B24C 1/04* (2006.01)
*B24C 5/02* (2006.01)

(52) U.S. Cl.
CPC ..... *B26F 3/004* (2013.01); *B24C 1/045* (2013.01); *B24C 5/02* (2013.01)

(58) Field of Classification Search
CPC . B24C 1/045; B24C 5/02; B26F 3/004; B26F 1/26; Y10T 83/364; Y10T 83/0591;
(Continued)

(56) References Cited

U.S. PATENT DOCUMENTS 4,008,009 A 2/1977 Kovacs et al.
4,465,445 A 8/1984 Sommer
(Continued)

FOREIGN PATENT DOCUMENTS

CN 1043459 A 7/1990
CN 103862525 A 6/2014
(Continued)

OTHER PUBLICATIONS

International Search Report for Application No. PCT/EP2015/074887 dated Jan. 18, 2016 (English Translation, 3 pages).

*Primary Examiner* — Ghassem Alie
(74) *Attorney, Agent, or Firm* — Michael Best & Friedrich LLP

(57) ABSTRACT

A method for liquid-jet cutting, including a compressor unit (3), which compresses a liquid for producing a liquid jet, and a nozzle (10), which is connected to the compressor unit (3) and which has an outlet opening (11), through which the compressed liquid exits in the form of a liquid jet (14). The one flow of the compressed liquid to the outlet opening (11) is interrupted or enabled by an interrupting unit (8). The following steps are performed: compressing the liquid by the compressor unit (3), moving the outlet opening (11) toward a workpiece (15) to be processed until a processing distance (d) is reached, alternately enabling and interrupting the liquid jet (14) by the interrupting unit (8), wherein simultaneously the nozzle is moved in relation to the workpiece in a processing direction (22) and the pulse duration ($t_p$; $t_{p1}$; $t_{p2}$) of the liquid jet is less than 1000 μs.

9 Claims, 3 Drawing Sheets

(58) Field of Classification Search
CPC ... Y10T 83/04; Y10T 156/13; Y10T 428/192; Y10T 156/1056
USPC .... 83/53, 177, 22; 239/4, 102.2, 102.1, 590, 239/590.5; 700/164, 195; 451/75
See application file for complete search history.

(56) References Cited

U.S. PATENT DOCUMENTS 4,594,924 A * 6/1986 Windisch ..... B26F 3/004 239/533.1
5,020,724 A 6/1991 Kiyono et al.
5,154,347 A 10/1992 Vijay
5,927,329 A 7/1999 Yie
6,280,156 B1 8/2001 Wirz et al.
6,875,084 B2 * 4/2005 Hashish ..... B24C 5/04 451/101
8,380,338 B2 * 2/2013 Miller ..... B08B 3/024 700/164
8,505,583 B2 8/2013 Yie
2005/0066785 A1 * 3/2005 Kissell ..... B26F 1/26 83/177
2007/0183696 A1 8/2007 Winterhalter
2008/0060493 A1 * 3/2008 Liu ..... B26F 1/26 83/53
2010/0288316 A1 11/2010 Ertle et al.
2011/0033320 A1 2/2011 Heier et al.
2012/0007009 A1 1/2012 Yie

FOREIGN PATENT DOCUMENTS

DE 19518263 A1 12/1995
DE 102013201797 8/2014
EP 2289437 3/2011
GB 2189170 B 12/1989

* cited by examiner

METHOD FOR LIQUID-JET CUTTING

BACKGROUND OF THE INVENTION

The present invention relates to a liquid jet cutting method, as is preferably used to cut up solid materials.

Methods for liquid jet cutting of solid materials have been known from the prior art for a relatively long time. Here, water is preferably compressed by way of a compressor unit to a very high pressure which is usually several thousand bar. The liquid subsequently flows through a nozzle, exits through an outlet opening and, as a result, forms a liquid jet which is directed onto the material to be cut up. On account of the high speed and the high pulse of the water, the water jet smashes the material in the region of the liquid jet and cuts it up as a result. Solid materials can be machined by way of said method, for example metal, glass, plastic, wood and similar materials. Since the compression of the water requires a large amount of energy and the liquid jet or the water jet is operated continuously, said material machining is possible only with a high power consumption which can be several tens of kilowatts in the customary known systems. The operating costs of a system of this type are correspondingly high, as is the required storage space on account of the large dimensions of such systems.

In order to improve the action of the water jet, it is likewise known to mix abrasive materials into the water jet, which abrasive materials are entrained by the water and strike the structural surface with high energy and thus improve the action of the water jet. However, the costs are increased further as a result of the addition of the abrasive materials, and the used water can no longer be simply returned into the circuit, since the abrasive materials first of all have to be filtered out in a complicated method and result in increased wear in the system.

DE 10 2013 201 797 A1 has disclosed an apparatus for liquid jet cutting, which apparatus does not use a continuous water jet for cutting up the material, but rather a pulsed water jet, in the case of which the liquid jet is interrupted at regular intervals. The pulsed liquid jet has the advantage, in particular, that the cutting device manages with a relatively low pressure and, above all, is considerably more energy-efficient than the known constant jet cutting methods. The operating parameters are of decisive significance, however, for an optimum action of the liquid jet cutting.

SUMMARY OF THE INVENTION

In contrast, the liquid jet cutting method according to the invention has the advantage that an efficient and energy-saving cutting method is ensured, which additionally leads to an improved cut edge, with the result that particularly smooth cut edges can be achieved. To this end, the liquid jet cutting method has a compressor unit which compresses a liquid for producing a liquid jet, and a nozzle which is connected to the compressor unit. The nozzle has an outlet opening, through which the compressed liquid exits in the form of a liquid jet, and with an interrupter unit which can interrupt or release a flow of the compressed liquid to the outlet opening. Here, the following method steps are carried out: the liquid is compressed by way of the compressor unit, the outlet opening is moved up to the workpiece to be machined as far as a machining distance, the liquid jet is released and interrupted in an alternating manner by way of the interrupter unit, the nozzle at the same time being moved with respect to the workpiece in a machining direction. Here, the pulse duration of the liquid jet is less than 1000 μs.

The following effects are achieved by way of the short pulse duration of the liquid jet: the liquid jet pulse which strikes the workpiece surface releases material from the surface of the workpiece, which material is washed away by way of the liquid of the liquid jet. The following liquid jet then no longer has to machine the workpiece through the already present liquid, but rather finds its way directly onto the workpiece surface and can continue the further machining. Depending on the workpiece and depending on the other operating parameters, the released material of the workpiece can also lead to a reinforcement of the cutting effect if individual particles are not washed away with the machining liquid, but rather remain in the region of the cutting operation. Said material is pressed into the workpiece by way of the following liquid jet pulse and leads to a reinforcement of the cutting action, in a similar manner to the addition of an abrasive medium in the case of the known continuous liquid jet cutting operation. The pulsed loading has the advantage, moreover, that cavitation effects occur on the surface of the workpiece, which further reinforces the removal of material.

The quality of the cut edges is likewise improved by way of the method according to the invention, since the machining liquid no longer has to escape to the side and damage the cut edges as a result.

In one advantageous refinement of the invention, the pulse duration is from 50 to 500 μs, the liquid jet advantageously being opened and closed periodically by way of the interrupter unit for producing liquid pulses. If the liquid pulses are produced periodically, the workpiece can be moved at a uniform speed in the machining direction, with the result that a cut line is produced in the workpiece.

In a further advantageous refinement, between 25 and 500 liquid pulses per second are produced, that is to say the liquid pulses are sprayed onto the workpiece at a frequency of from 25 to 500 Hz. The frequency of the liquid pulses is based on the machining speed, that is to say the speed, at which the nozzle moves relative to the workpiece, and on the thickness and the material properties of the workpiece.

In a further advantageous refinement, the spacing of the nozzle opening from the workpiece surface during the machining is from 0.5 to 2 mm, preferably from 1 to 2 mm. Said spacing ensures efficient machining of the workpiece, without it being possible for the water which sprays back to lead to damage of the nozzle.

In a further advantageous refinement, the nozzle is moved relative to the workpiece at a speed of from 10 to 1200 mm per minute, the advancing speed being dependent on the thickness of the workpiece and the material properties of the workpiece.

In a further advantageous refinement, the liquid pulses are carried out at a short time interval, and a following group of liquid pulses is at a time interval which is greater than the time interval of the liquid pulses of the individual groups. As a result, individual bursts which are spaced apart from one another temporally are formed by way of the liquid pulses, which leads to improved machining and a cleaner cut edge in certain materials. The cause of this is also that the machining liquid does not have to yield to the side in contrast to continuous machining.

In a further advantageous refinement, the nozzle has a nozzle body with a longitudinal bore, the longitudinal bore forming a pressure space, into which the compressed liquid is fed. The interrupter unit is formed by way of a nozzle needle which is arranged longitudinally displaceably within the pressure space and opens and closes the outlet opening by way of its longitudinal movement. Precise liquid pulses can be produced with the desired duration and at the desired frequency by way of said nozzle which is known, for example, from high pressure fuel injection.

Further advantages and advantageous refinements can be gathered from the description, the drawing and the claims.

BRIEF DESCRIPTION OF THE DRAWINGS

The following is shown in the drawing in order to illustrate the method according to the invention.

DETAILED DESCRIPTION

Figure 1:
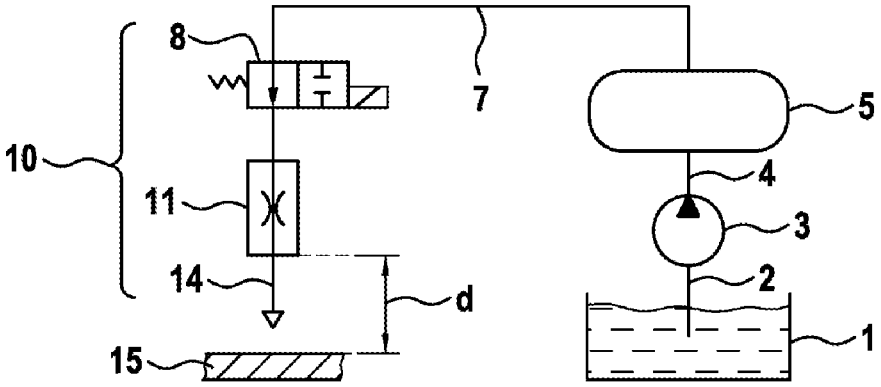
FIG. 1 shows a diagrammatic illustration of an apparatus for carrying out the liquid jet cutting method according to the invention.

FIG. 1 shows an apparatus for carrying out the liquid jet cutting method according to the invention. The liquid is stored in a tank 1, which liquid is used for liquid jet cutting, for example purified water; other liquids also conceivable, however. The liquid is fed out of the liquid tank 1 via a lining 2 to a compressor unit 3, for example a high pressure pump, where the liquid is compressed and is fed via a high pressure line 4 into a high pressure collecting space 5, where the compressed liquid is stored. The high pressure collecting space 5 serves to equalize pressure fluctuations, in order for it thus to be possible to carry out the liquid jet cutting at a constantly high pressure, without it being necessary for the compressor unit 3 to be adjusted at short time intervals. A pressure line 7 leads from the high pressure collecting space 5 to a nozzle 10, the nozzle 10 having an interrupter unit 8 (in the form of a 2/2-way valve here) and an outlet opening 11 in the form of a constricted passage for the liquid, with the result that a liquid jet 14 which is sharply focused and strikes a workpiece 15 during the operation exits from the outlet opening 11, said workpiece 15 being arranged at an operating distance d relative to the nozzle 10.

The method according to the invention is carried out as follows: highly compressed liquid is present via the pressure line 7 in the nozzle 10, the interrupter unit 8 being closed at the beginning. In order to produce a pulsed liquid jet 14, the interrupter unit 8 is then closed and opened at regular intervals, with the result that a pulsed liquid jet 14 exits through the outlet opening 11, which pulsed liquid jet 14 strikes the surface of the workpiece 15. Upon the contact of the liquid on the workpiece 15, the relevant regions are smashed, and the fragments are washed away via the liquid which flows out. The workpiece is cut up as a result, the cut line being produced by way of a movement of the workpiece 15 in a machining direction, it also being possible for provision to be made that it is not the workpiece 15, but rather the nozzle 10 which is moved relative to the workpiece 15 by way of a suitable apparatus.

Figure 2:
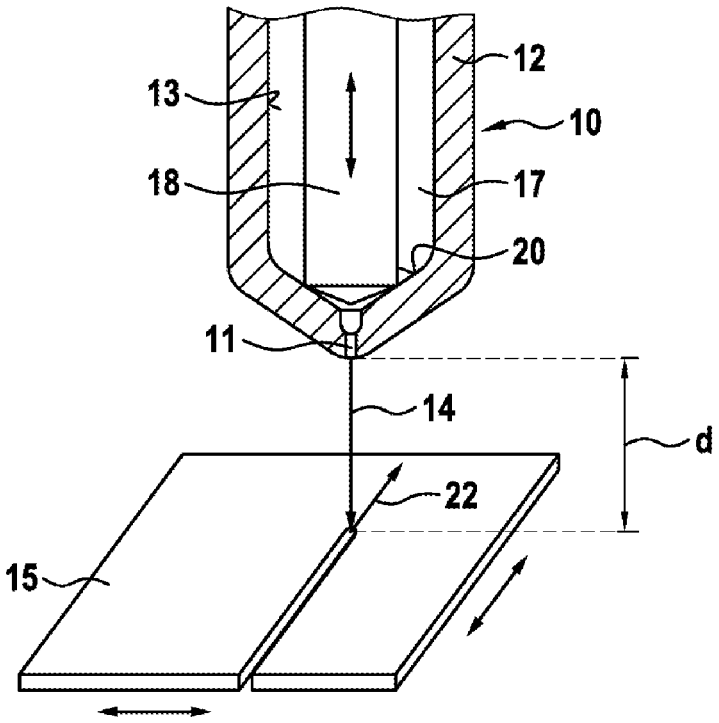
FIG. 2 shows a likewise diagrammatic illustration of the nozzle for liquid jet cutting.

To this end, FIG. 2 shows a diagrammatic illustration of a nozzle 10 according to the invention with the associated workpiece 15. The nozzle 10 which is shown here has a nozzle body 12, in which a bore 13 is configured, in which a nozzle needle 18 is arranged longitudinally displaceably. A pressure space 17 is configured between the wall of the bore 13 and the nozzle needle 18, into which pressure space 17 the highly compressed liquid is fed via the pressure line 7. The nozzle needle 18 interacts with a nozzle seat 20, with the result that, when the nozzle needle 18 bears against the nozzle seat 20, the pressure space 17 is separated from the injection opening 11 which is configured as a bore in the nozzle body 10. When the nozzle needle 18 lifts up from the nozzle seat 20, liquid flows out of the pressure space 17 through the outlet opening 11 and forms a liquid jet 14 which strikes the workpiece 15.

In order to cut up the workpiece, the nozzle needle 18 is moved up and down periodically and thus releases the liquid jet 14 or interrupts the liquid feed between two injection operations. The workpiece 15 is moved in the machining direction 22, it being unimportant whether the workpiece or the nozzle is moved or even both are moved at the same time.

Figure 3A:
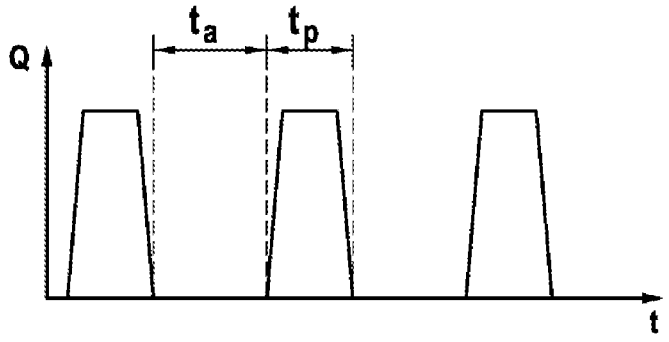
FIGS. 3*a*, 3*b* and 3*c* show various temporal evolvements of the liquid jet, likewise in a diagrammatic illustration.
Figure 3B:
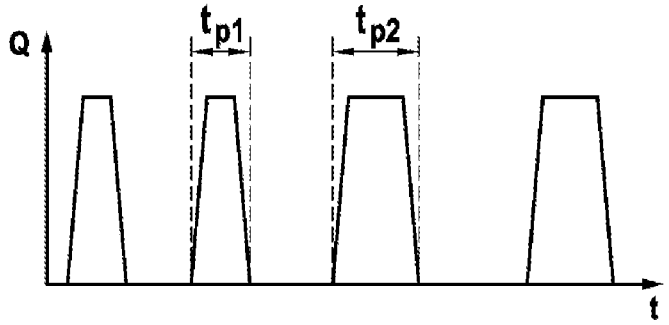

FIG. 3*a* diagrammatically shows the temporal evolvement of the liquid jet, the discharged liquid quantity per unit time Q being plotted on the ordinate and the time t being plotted on the abscissa. By way of the opening and closing of the interrupter unit 8, a liquid jet 14 is ejected periodically out of the nozzle 10, the individual pulses having a time $t_p$ and a time interval from one another of $t_a$. The pulses can follow one another periodically, as shown here, and can all be of identical configuration, or different pulses can also be produced, as shown in FIG. 3*b*, which have different time durations $t_{p1}$ and $t_{p3}$ and are also at different time intervals from one another. It is possible, for example, to react to a changed advancing speed by way of the different shaping of the injection pulses, that is to say fewer pulses are generated per unit time in the case of a reduced advancing speed than in the case of a great advancing speed. The frequency of the injection pulses can likewise be increased if the thickness of the workpiece increases or if the strength of the workpiece changes over the machining length.

The duration of the liquid pulses $t_p$ is less than 1000 μs, preferably from 50 to 500 μs, in order to achieve an optimum cut edge depending on the material. The pulsed liquid jet cutting is particularly satisfactorily suitable for cutting up fiberglass or carbon fiber plates (CFRP) or metal plates, for example aluminum. Specifically for the machining of CFRP materials, the pulsed liquid jet cutting provides a considerable advantage over constant liquid jet cutting with a considerably smoother cut edge, that is to say the fraying of the carbon fibers at the edge of the cut edge is largely prevented. At the same time, the energy input when cutting up a CFRP plate can be lowered by up to a factor of 20. Moreover, the pulsed water jet cutting manages with a lower pressure. The liquid is stored within the nozzle 12 at a pressure of, typically, 2500 bar, with an increase in pressure to 3000 bar also being possible. This is considerably reduced in comparison with the otherwise known constant liquid jet cutting methods, which usually operate at up to 6000 bar and associated with a correspondingly lower energy consumption.

Figure 3C:
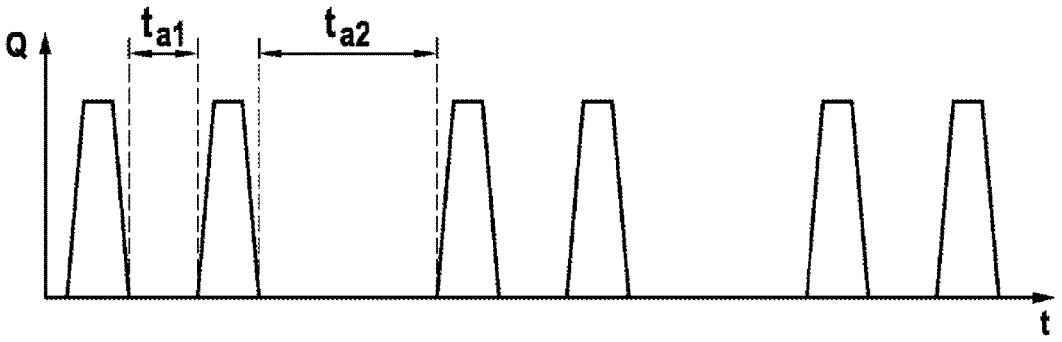

In addition to the periodic switching on and off of the liquid jet, it is also possible to break down the liquid pulses into individual bursts, as shown in FIG. 3*c*. Here, in each case two pulses follow one another at a short time interval $t_{a1}$, whereas a longer time period $t_{a2}$ passes until the next injection pulse. More than two pulses can also be combined in one burst, with the result that individual groups of injection pulses are produced. This is advantageous, in particular, when machining relatively thick materials.

The machining distance of the nozzle 10 from the workpiece 15 (denoted by din FIG. 1 and FIG. 2) is preferably from 0.5 to 2 mm, most preferably from 1 to 2 mm. At said machining distance d, an optimum action is achieved, without it being necessary to expect damage of the nozzle as a result of liquid which sprays back.

The pulsed liquid jet cutting is suitable in the case of CFRP materials, in particular, for plates with a thickness of up to 2 mm, the diameter of the liquid jet being approximately 150 μm. The pressures which are used are approximately 2400 bar, it also being possible for operation to be carried out with a lower liquid pressure. Optimum cycle rates are more than 40 Hz at a pulse duration of 1000 μs or less, it being necessary for the cycle rate to be adapted to the advancing speed of the machining, that is to say the cycle rate must be higher, the more rapid the advancing speed.

The liquid jet is interrupted periodically by means of the interrupter unit in order to achieve the liquid pulses. In the context of this invention, however, the term "interrupt" does not necessarily denote complete closure of the outlet opening at the nozzle. It can also mean that the interrupter unit merely throttles the liquid jet to a very pronounced extent, but that some liquid at a low pressure still exits between the liquid pulses. The effects which are described are then also achieved, provided that the throttling is sufficiently pronounced.

The invention claimed is:

1. A liquid jet cutting method utilizing a compressor unit (3) which compresses a liquid for producing a liquid jet, a nozzle (10) which is connected to the compressor unit (3) and has an outlet opening (11), through which the compressed liquid exits in the form of a liquid jet (14), and an interrupter unit (8) which can interrupt or release a flow of the compressed liquid to the outlet opening (11), the method comprising:

compressing the liquid by way of the compressor unit (3), moving up the outlet opening (11) to a workpiece (15) to be machined as far as a machining distance (d), and releasing and interrupting the liquid jet (14) out of the outlet opening (11) in an alternating manner by way of the interrupter unit (8), the nozzle at the same time being moved relative to the workpiece in a machining direction (22), wherein the pulse duration ($t_p$; $t_{p1}$; $t_{p2}$) of the liquid jet is less than 1000 μs, and wherein individual groups of liquid pulses are carried out with a short temporal interval ($t_{a1}$), with a time interval ($t_{a2}$) between the individual groups being greater than the temporal interval ($t_{a1}$) of the liquid pulses of the individual groups.

2. The method as claimed in claim 1, characterized in that the pulse duration ($t_p$; $t_{p1}$; $t_{p2}$) is from 50 to 500 μs.

3. The method as claimed in claim 1, characterized in that the liquid jet (14) is opened and closed periodically by way of the interrupter unit (8) in order to produce liquid pulses.

4. The method as claimed in claim 1, characterized in that the interrupter unit (8) is arranged in the nozzle (10).

5. The method as claimed in claim 1, characterized in that between 25 and 500 liquid pulses per second are produced.

6. The method as claimed in claim 1, characterized in that the machining distance (d) of the outlet opening (11) from the workpiece surface during the machining is from 0.5 to 2 mm.

7. The method as claimed in claim 1, characterized in that the nozzle (10) is moved during the machining relative to the workpiece surface at an advancing speed of from 10 to 1200 mm per minute.

8. The method as claimed in claim 1, characterized in that the nozzle (10) has a nozzle body (12) with a bore (13), and the bore (13) forms a pressure space (17), into which the compressed liquid is fed, the interrupter unit (8) being formed by way of a nozzle needle (18) which is arranged longitudinally displaceably within the pressure space (17) and opens and closes the outlet opening (11) by way of its longitudinal movement.

9. The method as claimed in claim 1, characterized in that the machining distance (d) of the outlet opening (11) from the workpiece surface during the machining is from 1.0 to 2.0 mm.

* * * * *